United States Patent [19]

Kotzur

[11] Patent Number: 4,523,723

[45] Date of Patent: Jun. 18, 1985

[54] WINDING FLEXIBLE MATERIAL WITH LAYER SHIFTING

[75] Inventor: Frank W. Kotzur, Mahopac, N.Y.

[73] Assignee: Windings, Inc., Goldens Bridge, N.Y.

[21] Appl. No.: 532,043

[22] Filed: Sep. 14, 1983

[51] Int. Cl.[3] ..... B65H 55/04

[52] U.S. Cl. ..... 242/43 R; 242/18 R; 242/163

[58] Field of Search ..... 242/163, 159, 18 R, 242/43 R, 1, 2, 47, 174, 176, 177, 178

[56] References Cited

U.S. PATENT DOCUMENTS

| | | | |
|---|---|---|---|
| 2,634,922 | 4/1953 | Taylor, Jr. | 242/163 |
| 2,767,938 | 10/1956 | Taylor, Jr. | 242/163 |
| 3,178,130 | 4/1965 | Taylor, Jr. | 242/163 |
| 3,666,200 | 5/1972 | Newman et al. | 242/163 |
| 4,406,419 | 9/1983 | Kotzur | 242/163 X |

*Primary Examiner*—Stanley N. Gilreath

*Attorney, Agent, or Firm*—Watson, Cole, Grindle & Watson

[57] ABSTRACT

A universal winding consisting of a plurality of successive figure-8s spaced radially around a mandrel with the figure-8s being spaced such that the crossovers exist in all but one location to form a payout hole extending from the exterior of the winding into the interior of the axial opening therein in which the speed of the traverse or speed of the mandrel is varied with respect to one another in such a manner that a greater density winding is obtained having a more uniform density, thereby enabling the winding to be compressed more uniformly around the diameter of the coil. A variation in the speed of the traverse or the speed of the spindle with respect to one another can be defined as either a plus or a minus gain and small changes in the gain place the crossovers such that the flexible material is wound more densely. The invention has particular application to large diameter winds in which relatively large diameter flexible material is wound.

5 Claims, 3 Drawing Figures

WINDING FLEXIBLE MATERIAL WITH LAYER SHIFTING

BACKGROUND OF THE INVENTION

1. Field of the Invention

This invention is directed to the winding of flexible material in a universal figure-8 pattern around a mandrel, and in particular to such windings in which a crossover is formed in all but one location so as to generate a payout hole extending from the exterior of the winding to the interior axial opening therein and wherein the gain of the winding, defined as the ratio of the speed of traverse to the speed of the spindle, is varied in either a positive or negative manner so as to increase the density of the wind by displacing the crossovers with respect to one another.

2. Prior Art

The winding of flexible material about a mandrel with successive figure-8s spaced radially around the mandrel and with a radial opening extending from the exterior of the winding to the interior core thereof is known from U.S. Pat. Nos. 3,178,130 and 4,406,419 assigned to the assignee of the present invention. The figure-8s are spaced such that the crossovers exist in all but one location and the absence of the crossovers is the location of the payout hole. In the case of a one wind, the spindle travels at a given speed and its traverse is travelling exactly one-half the spindle speed, and all crossovers of the figure-8s will be in the same place. The winding as defined in the aforementioned patent, as well as U.S. Pat. No. 3,666,200, which is also assigned to the assignee of the present application, is satisfactory with regard to relatively small diameter winds in which the flexible material being wound is of relatively small diameter. However, as the diameter of the wind is increased and the diameter of the flexible material being wound is of relatively large diameter, the location of the crossovers at the same place in the winding results in an inefficient winding, i.e., one that is less dense and which has a high crest and valley produced in the wind.

U.S. Pat. No. 3,666,200 suggests the variation of the gain of the wind such that the crossovers of the figure-8s are displaced with respect to one another in order to obtain a more compact and more dense wind. However, there is a necessity to improve the method of winding flexible material for large diameter winds especially in the instances where relatively large diameter flexible material is being wound. Additionally, it is common practice to compress a winding wound in accordance with the teachings of the aforementioned prior art patent to make the winding density more uniform such that the finished winding can be packaged in a smaller box.

SUMMARY OF THE INVENTION

An important feature of the invention is to vary the gain such that the upper ratio and the lower ratio are essentially equal and to utilize the upper and lower ratio, or the plus or minus gains, alternately in successive crossovers of the winding, which is wound in all other respects in accordance with the prior art teachings. In accordance with the invention, one gain is used for one crossover or until the advance has been displaced by one-half a normal crossover angular displacement. The gain is then shifted back to the normal advance such that the first crossover is placed between the last two layers of the upper ratio and all other crossovers of the layer between the crossovers of the upper ratio layer. The layer is finished using that lower ratio and when the material is at the hole the winding gain is switched to an upper ratio that is also half for one crossover or one-half the advance of a crossover angular displacement. The gain is then returned to normal. This method of winding results in a more dense package and also decreases the package cost as a given amount of winding can be placed in a smaller container or box. Inasmuch as the resulting density of the winding is more uniform, the compression thereof will be more uniform around the diameter of the coil, and the winding will be more stable.

BRIEF DESCRIPTION OF THE DRAWINGS

The above objects, advantages and features of the invention are more readily apparent from a consideration of the following description of a preferred embodiment representing the best mode of carrying out the invention when taken in conjunction with the drawings, wherein.

DETAILED DESCRIPTION OF THE PREFERRED EMBODIMENT

A winding in accordance with the invention is formed by winding figure-8s spaced radially around a mandrel, or the layer of material beneath the one layer being wound. The figure-8s are spaced such that the crossovers exist in all but one location and the absence of crossovers generates a payout hole through which the inner end of the winding may be withdrawn such that the winding is paid out from the inside out through the payout hole.

In the case of a one wind, the spindle travels at some given speed $\omega S$. If the traverse is travelling exactly one-half the spindle speed, all the crossovers of the figure-8 will be in the same place. If an advance G is applied to the traverse, the figure-8 will be laid in different places. A formula to describe the motion of the traverse is:

$$\omega_T = \frac{\omega_S}{2}(1 + G)$$

where:

$\omega_T$=speed of traverse (RPM)

$\omega_S$=speed of spindle or mandrel (RPM)

G=gain (+ or −)

Since distance equals rate times time $S=\theta_S/t$ where $\theta_S$=distance travelled by the spindle and the distance travelled by the traverse is known if the distance travelled by the spindle is known, thus:

$$\frac{\theta_T}{t} = \frac{\theta_S}{2t}(1 + G)$$

-continued $$\theta_t = \frac{\theta_S}{2}(1 + G)$$

The formulas and derivations described herein only represent the velocities or displacements of the traverse cam. The traverse cam and associated traversing mechanism forms a rotary-to-linear translator where the actual traverse pattern is dependent on the "cut" or shape of the traverse cam.

A layer is complete (disregarding the payout hole for the present) when the spindle has travelled twice the traverse distance plus or minus one revolution.

$$2\theta_T \pm 1 - \theta_S$$

$$\text{since } \theta_T = \frac{\theta_S}{2}(1 + G)$$

$$\theta_S(1 + G) \pm 1 = \theta_S$$

$$\frac{\pm 1}{G} = \theta_S \quad (1)$$

$$\theta_T = \frac{\pm(1 + G)}{2G} \quad (2)$$

From equation 2, the number of traverse strokes will be known if the advance G is known (since $\theta_T$ is in revolutions). A traverse stroke is one complete cycle from one end to the other and back to the starting point.

Figure 1:
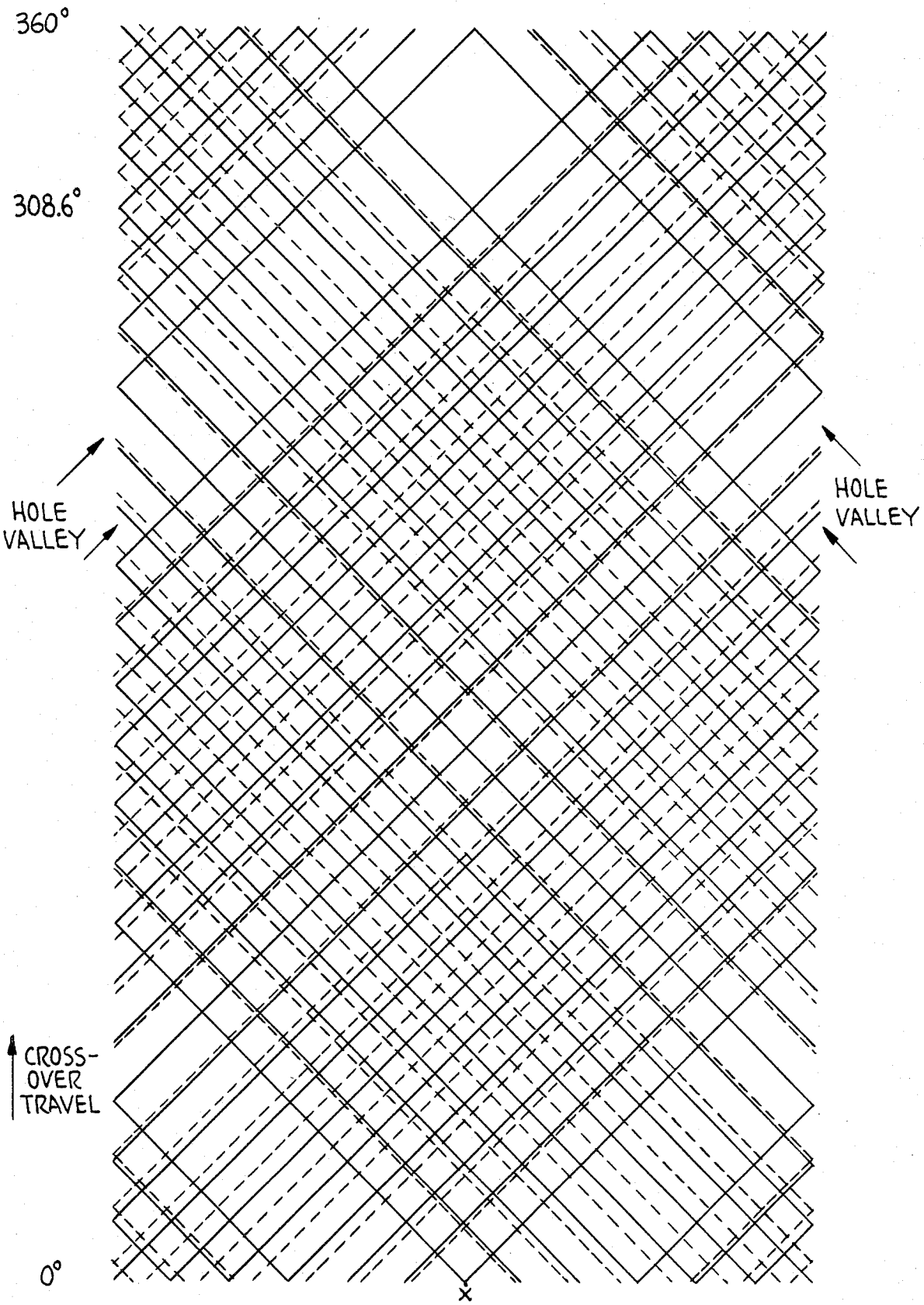
FIG. 1 is an arbitrary sketch of two winds each consisting of two layers wherein the solid wind represents an upper ratio and the dotted lines represent a lower ratio of winding.

FIG. 1 illustrates an arbitrary sketch of two windings each consisting of two layers. The winding represented by the solid lines is an upper ratio and the winding represented by the dotted lines is a lower ratio. The sketch is only a section taken from the inner portion of the wind and the actual pattern and area of turnaround will be dependent on the shape of the traverse cam (or traverse displacement characteristics). The sketch has been laid out for simplicity by separating at point X. The sketch is on a mandrel of circumference ten and one-half inches. The payout hole is one-half inch from end to end. This represents a hole of 1.5/10.5 times 360° =51.4°.

There are nineteen crossovers in the winding represented by the solid lines which is an upper ratio layer. This represents a spacing of 308.6° /18=17.14° between each crossover. The spacing is one-half inch. If the payout hole is considered, there would be twenty-one crossovers. This represents a gain of:

$$21 = \frac{(1 + G)}{2G}$$

$$G = \frac{1}{41} = .0244 = 2.44\%$$

This means that the traverse is 2.44% faster than one-half the spindle RPM to produce that pattern.

It is to be noted that in both windings, the center crossover is shown in the center of the drawing which is not the actual case for an actual winding. In an actual winding, the center crossover will be on the left or right of the center line alternately, and the amount of shift from the center will be dependent on the amount of gain.

The windings represented by the dotted lines in FIG. 1 are of a lower ratio which represents a gain of 0.0208 or 2.08%.

The pattern represented by FIG. 1 can be performed or made on known winding equipment by using an upper ratio of twenty-four and a lower ratio of twenty-one.

The important aspect of the windings illustrated in FIG. 1 is that near the vicinity of the payout hole, both winding layers coincide with one another. This is understandable inasmuch as a 2.4% advance is not too different from a 2.1% advance. If the gains were made radically different, the first crossover or two near the hole would still be near one another. Also, the package density would suffer if one used 2.4% and 3.6%, for example.

This pattern of nearness becomes destroyed about the third or fourth crossover down, but begins again about the seventh or eighth and is overlapping again at the tenth crossover. The sequence then starts from there until the other side of the payout hole. It is then seen that there are two areas of dense winding and an area in the center that is not so dense.

Figure 3:
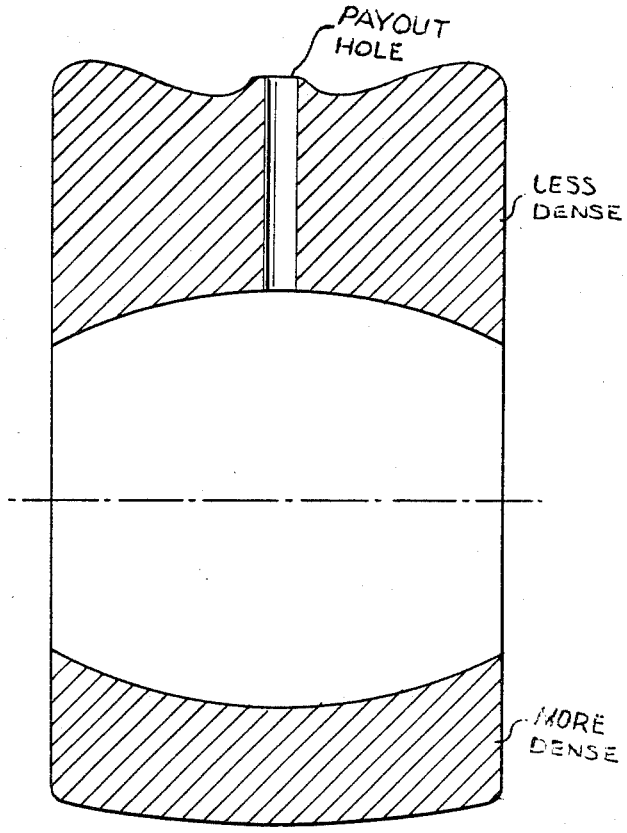
FIG. 3 represents a cross-section honeycomb type of winding illustrating a winding having a thicker wall that is less dense and a thinner wall that is more dense.

If a larger diameter material is wound, the gains must be larger to allow enough space for the material. If a gain of forty-five (4.5%) was used, there would be 11.6 crossovers, assuming the payout hole is neglected. If the other gain was 4.1%, there would be 12.6 crossovers. This means that a "honeycomb" pattern would not be destroyed completely until a point 180° from the hole was reached. The coil would then be dense in the back (180° from the hole) and relatively undense in the vicinity of the hole. Such a winding is illustrated in cross-section in FIG. 3.

In accordance with the invention, it is proposed to eliminate this problem by shifting the layers. The honeycomb winding illustrated in FIG. 3 indicates that such a winding is inefficient as far as density is concerned. In such a winding, both layers are of the same gain. However, if alternate layers are shifted downwardly one-half a crossover distance, the pattern that is generated is quite dense.

Figure 2:
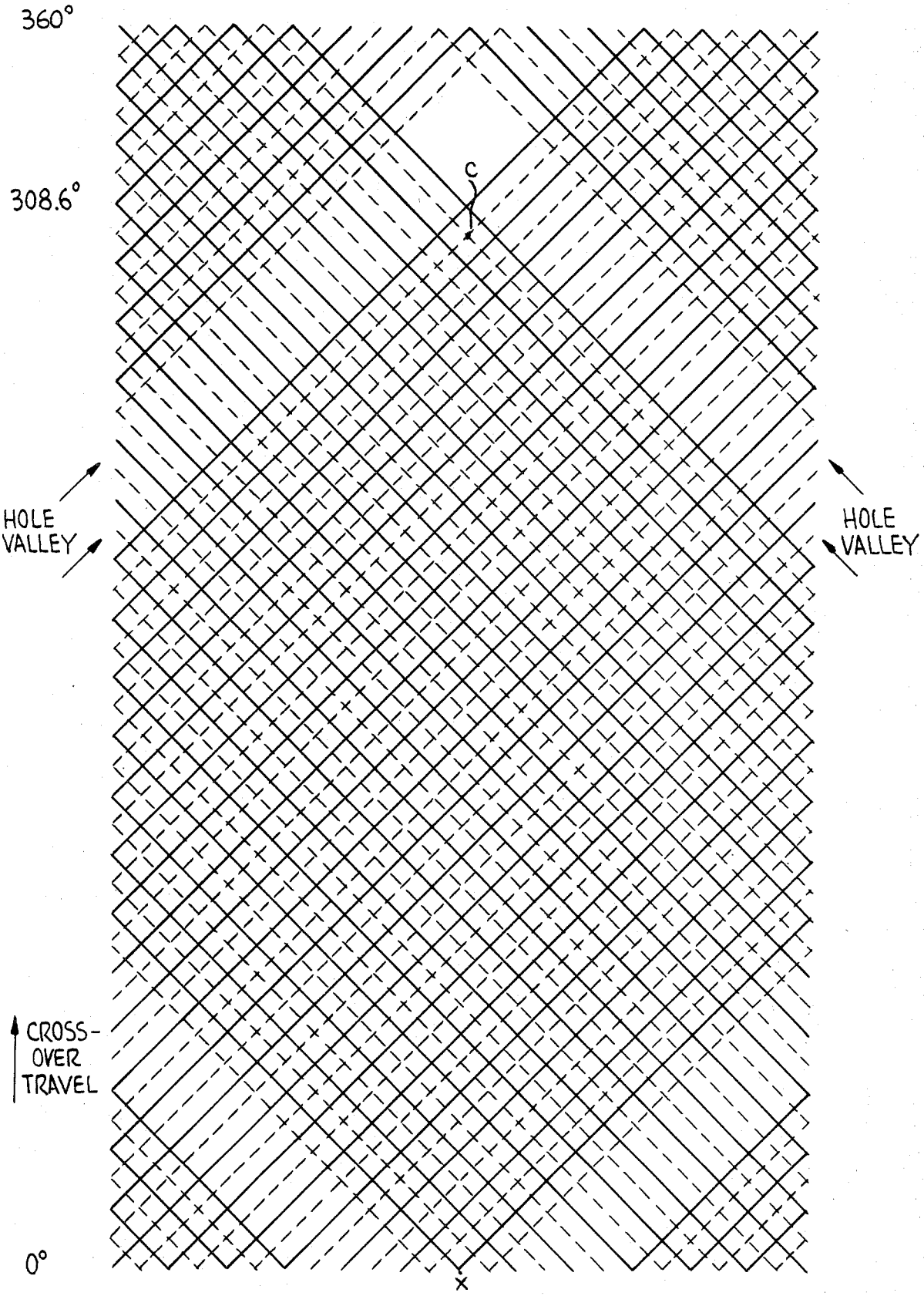
FIG. 2 is another arbitrary sketch of two windings each consisting of two layers wherein the solid lines represent an upper ratio and the dotted lines represent a lower ratio wherein the winding represented by the Figure is in accordance with the invention.

As indicated above, the aforementioned problem of density is solved by the method of winding in accordance with the invention as illustrated in FIG. 2. In accordance with that Figure, the upper ratio winding and the lower ratio winding have the same gain (the same number of crossovers and therefore the same spacing between the crossovers). For example, if the gain is 4.1%, such gain will be used as both a plus or minus gain.

The upper ratio is wound as illustrated by the solid lines in FIG. 2, but when the last crossover in the layer is wound (the crossover just above the topmost C in the drawings) the winding is shifted to a lower gain which is one-half of the gain used (in this case 2.05%).

The method proposes that the gain be used for one crossover or until the advance has been displaced by one-half a normal crossover angular displacement. The gain is then shifted back to the normal 4.1 advance gain. This will place the first crossover of the lower ratio between the last two layers of the upper ratio, and all the other crossovers will lay between the crossovers of the upper ratio layer. The lower ratio layer, represented by the dotted lines in FIG. 2, will finish its layer and at the hole it will switch to an upper ratio that is also one-half (2.05%) gain for one crossover or one-half the advance of a crossover angular displacement. The gain is then returned to the normal 4.1%.

The resulting package wound in accordance with the invention is considerably more dense than that wound if the gain were not altered. The package cost is reduced because the resultant winding can be packaged in a smaller box with the same amount of wound material. Because the density is uniform, the compression of the winding will also be more uniform around the diameter of the coil. This results in greater wind stability and less resistance during wind payout through the radial hole of the winding.

Those skilled in the art will also recognize that the invention as described herein is capable of being modified in accordance with known principles and techniques applicable to the art of winding flexible material, and therefore the present invention is not intended to be limited by the specific embodiment herein described but the scope of the invention is to be determined by the following claims with consideration being given to the equivalence of the claimed components, individually and collectively in combination.

What is claimed is:

1. A method of winding a package of flexible material in a figure-8 pattern upon a mandrel by rotating the mandrel and winding the flexible material thereon from a traverse mechanism reciprocating in a direction along the axis of rotation of the mandrel and with the winding crossovers progressing around the winding to form a radial opening extending from the exterior of the winding to the interior thereof, comprising winding the flexible material with a normal gain representing a given ratio of the speed of the traverse mechanism with respect to the speed of the mandrel rotation for at least one layer of wind, adjusting the normal gain to a lower or higher gain at the last winding crossover in the first winding layer until the angular displacement of the winding crossover has been displaced a given amount, adjusting the gain to said normal gain and upon completion of at least a layer with said normal gain adjusting the gain by an amount substantially equal to the aforesaid first gain adjustment but in a direction opposite thereto until the angular displacement of the winding crossover has been displaced a given amount, adjusting the gain back to said normal gain, and upon completion of at least a layer with said normal gain repeating the aforementioned gain adjustments until the wind is complete.

2. The method as set forth in claim 1 wherein the gain adjustment in each of said steps of adjusting the gain is equal to one-half the difference between said lower and said higher gain.

3. The method as set forth in claim 1 wherein said lower gain equals said higher gain.

4. The method as set forth in claim 1 in which the displacement of the adjacent winds in a layer of wind during each adjustment of gain from a normal gain is one-half of that crossover angular displacement obtained with said normal gain.

5. The method as set forth in claim 1 wherein the distance travelled by the mandrel, $\theta_S$ equals 1/G, where G is defined as the gain, and $\theta_T$ equals (1+G)/2G, where $\theta_T$ is the distance travelled by the traverse mechanism.

* * * * *